US007406277B2

(12) United States Patent
Mizumoto

(10) Patent No.: US 7,406,277 B2
(45) Date of Patent: Jul. 29, 2008

(54) SEMICONDUCTIVE RUBBER MEMBER

(75) Inventor: Yoshihisa Mizumoto, Hyogo (JP)

(73) Assignee: Sumitomo Rubber industries, Ltd., Kobe-shi (JP)

( * ) Notice: Subject to any disclaimer, the term of this patent is extended or adjusted under 35 U.S.C. 154(b) by 127 days.

(21) Appl. No.: 11/139,586

(22) Filed: May 31, 2005

(65) Prior Publication Data

US 2006/0269327 A1 Nov. 30, 2006

(51) Int. Cl.
*G03G 15/02* (2006.01)

(52) U.S. Cl. ..... 399/176; 399/286; 399/313

(58) Field of Classification Search ..... 399/176, 399/286, 357, 313, 350; 524/495
See application file for complete search history.

(56) References Cited

U.S. PATENT DOCUMENTS

2004/0110617 A1 6/2004 Mizumoto

FOREIGN PATENT DOCUMENTS

| | | | | |
|---|---|---|---|---|
| CN | 1503065 | A | | 6/2004 |
| JP | 2001-357735 | A | | 12/2001 |
| JP | 2002-194203 | A | | 7/2002 |
| KR | 2004042836 | A | * | 5/2004 |

* cited by examiner

*Primary Examiner*—David M Gray
*Assistant Examiner*—Ryan D. Walsh
(74) *Attorney, Agent, or Firm*—Birch, Stewart, Kolasch & Birch, LLP

(57) ABSTRACT

A conductive rubber roller 10 has a conductive rubber layer 1, containing chloroprene rubber, and composes an outermost layer thereof. When an alternating current is applied to the conductive rubber roller 10 at a voltage of five and a frequency of 100 Hertz, the dielectric loss tangent is 0.1 to 1.8.

6 Claims, 2 Drawing Sheets

SEMICONDUCTIVE RUBBER MEMBER

BACKGROUND OF THE INVENTION

1. Field of the Invention

The present invention relates to a semiconductive rubber member that is used as a developing roller, a cleaning roller, a charging roller, a transfer roller, and the like mounted on an electrophotographic apparatus. More particularly, the present invention relates to a semiconductive rubber member which can be used preferably as the developing roller for attaching an nonmagnetic one-component toner to a photoreceptor by imparting a high charging property to the nonmagnetic one-component toner. The developing roller is used in an image-forming mechanism of an electrophotographic apparatus such as a laser beam printer and the like.

2. Description of the Related Art

In recent years, regarding an electrophotographic apparatus such as a laser printer, research has been widely made to realize a high-speed operation and form a high-quality image. To cope with the situation, polymerized toner that is spherical and can be reduced in the diameter thereof has come to be widely used.

As the polymerized toner, a one-component toner not using a carrier has come to be widely used instead of a two-component toner, composed of a carrier consisting of ferrite powder or iron powder and a toner, which has been hitherto used because it is easy to design on the mixing of the carrier and the toner. In such a situation, as the developing roller which receives toner and supplies it faithfully to a toner image formed on the photoreceptor, magnetic type which has been mainly used is being replaced with a semiconductive elastic rubber roller.

When the two-component toner using the carrier is used, it is easy to transport the toner to the photoreceptor owing to electrical and magnetic actions. But when the one-component toner is used, the magnetic action cannot be utilized to transport the toner. Therefore it is necessary to uniformly form the surface of the developing roller which is the end surface of an electrode. Further to uniformly attach the toner, the particle diameter of which is of a micron order to the photoreceptor, it is necessary that the electrical properties represented by an resistance value is uniform inside the developing roller so that when a bias electric potential is applied to the developing roller, a uniform electric potential distribution is obtained.

Because the one-component toner does not contain the carrier, the developing roller is required to have the function of controlling the charging property of the toner. That is, the developing roller is required to impart charging property to the toner and maintain the charging property imparted to the toner. When the charged amount of the toner is insufficient, an electrostatic force is insufficient and hence the toner is not transported to the electrostatic latent image formed on the photoreceptor. Consequently owing to the rotation of the developing roller, there occur a change in density, generation of a ghost image, photographic fog, and the like.

To comply with the above-described demands, various developing rollers are proposed. For example, disclosed in Japanese Patent Application Laid-Open No. 2002-194203 (patent document 1) is the rubber member, for electrophotographic use, made of the rubber material containing the ionic-conductive epichlorohydrin rubber and the calcium carbonate, whose particle diameter is restricted to a specific diameter, which is dispersed in the epichlorohydrin rubber. In the rubber member, the electric resistance of the rubber member is controlled not electronically because a conductive filler is not used but by ionic conduction to improve uniformity and enhance processing accuracy by using the filler. But the performance for charging toner and the durability of the electric charge imparted thereto are not high. Thus when the rubber member is used as the developing roller, it does not provide a high-quality image.

In the disclosure made in Japanese Patent Application Laid-Open No. 2001-357735 (patent document 2), to control the performance for charging toner, the surface of the conductive member is coated with the treating agent containing the amine compound. A very high dimensional accuracy is demanded for the developing roller. Thus a specific apparatus is required to treat the surface of the conductive member with high accuracy. Further the yield is very low, which leads to an increase of the manufacturing cost. In addition, because the material of the conductive member and the material of the coating agent are different from each other, the coating agent will separate from the surface of the conductive member when the conductive member is manufactured or when it is used.

As described above, to impart a high charging property to the unmagnetic one-component toner, the developing roller is required to have the performance of applying an electrical charge to the toner and maintaining the applied electrical charge. When a coating layer is formed on the surface of rubber layer, the cost for manufacturing the developing roller is high. Therefore it is difficult to form the coating layer. Even if the coating layer is formed on the surface of rubber layer, it may separate therefrom.

Patent document 1: Japanese Patent Application Laid-Open No. 2002-194203

Patent document 2: Japanese Patent Application Laid-Open No. 2001-357735

SUMMARY OF THE INVENTION

The present invention has been made in view of the above-described problems. Therefore it is an object of the present invention to provide a semiconductive rubber member which can be manufactured at a low cost, does not have a coating layer on the outermost layer thereof, is uniform in its electric resistance and thus allows toner to be uniformly attached to a photoreceptor, is excellent in the performance of imparting an charging property to the toner and maintaining the charging property imparted thereto, and can be preferably used as a developing roller.

The present inventors have investigated various materials and found that it is possible to impart a very high electrical charge to toner or the like by composing the outermost layer of the developing roller of a rubber material containing chloroprene rubber and prevent the leak of an electrical charge imparted to the toner by adjusting the dielectric loss tangent of the developing roller to 0.1 to 1.8 when an alternating current is applied to the developing roller at a voltage of five volts and a frequency of 100 Hertz.

The reason a low voltage of five volts is applied to the developing roller as the condition of measuring the dielectric loss tangent is because when the semiconductive rubber member is used as the developing roller, a very slight voltage variation occurs when the developing roller holds the toner thereon and when the toner is transported to a photoreceptor.

A low frequency of 100 Hertz is set in consideration of the number of rotations of the developing roller and the nip between the developing roller and each of members including the photoreceptor, a blade, and a toner supply roller close to or contacting the developing roller.

It is possible to impart a very high electrical charge to the toner by using the chloroprene rubber for the rubber component of the conductive rubber layer.

The chloroprene rubber is a polymer of chloroprene manufactured by emulsion polymerization. The chloroprene rubber is classified into a sulfur-modified type and a non-sulfur-modified type according to the kind of a molecular weight modifier.

The sulfur-modified type is produced by copolymerizing sulfur and the chloroprene with each other to form a polymer and plasticizing the copolymerizate with thiuram disulfide so that it has a predetermined Mooney viscosity.

In the case of the non-sulfur-modified type, a mercaptan-modified type and a xanthogen-modified type are listed. As the mercaptan-modified type, alkyl mercaptans such as n-dodecyl mercaptan, tert-dodecyl mercaptan, octyl mercaptan, and the like are used as the molecular weight modifier. As the xanthogen-modified type, alkyl xanthogen compounds are used as the molecular weight modifier.

The chloroprene rubber is classified into a type having an intermediate crystallization speed, a type having a low crystallization speed, and a type having a high crystallization speed according to the crystallization speed of the generated chloroprene rubber.

In the present invention, any type can be used. But the non-sulfur-modified type having a low crystallization speed is preferable.

In the present invention, as the chloroprene rubber, it is possible to use a rubber or an elastomer having a structure similar to that of the chloroprene rubber. For example, it is possible to use a copolymer obtained by polymerizing a mixture of the chloroprene and one or more copolymerizable monomers. As monomers copolymerizable with the chloroprene, it is possible to list 2,3-dichloro-1,3-butadiene, 1-chloro-1,3-butadiene, sulfur, styrene, acrylonitrile, isoprene, butadiene, acrylic acid, methacrylic acid, and esters of these acids.

When the semiconductive rubber member of the present invention using the above-described chloroprene rubber as the rubber component thereof is used as the developing roller, it is possible to hold the charged amount of the toner present on the surface of the developing roller on a high level before the developing roller contacts the photoreceptor. Thereby a high-quality image can be formed. The conductive rubber roller eliminates the need for forming a surface-coating layer thereon. That is, it is unnecessary to multi-layer the conductive rubber roller. Therefore it is possible to manufacture the semiconductive rubber member at a low cost without using a particular equipment and without deteriorating the yield of products.

The content of the chloroprene rubber is selected in the range of 1 to 100 parts by weight for 100 parts by weight of the rubber component. In view of the effect of imparting charging property to toner, it is favorable that not less than about 5 parts by weight of the chloroprene rubber is used for 100 parts by weight of the rubber component. To make the rubber uniform, it is more favorable that not less than 10 parts by weight of the chloroprene rubber is contained for 100 parts by weight of the rubber component.

When the conductive rubber layer is composed of a mixture of the chloroprene rubber and other rubbers, it is possible to use the following rubbers singly or mixtures of the rubbers as other rubbers: a polyether polymer containing epihalohidrin rubber (especially epichlorohydrin rubber), urethane rubber, acrylonitrile rubber, butadiene rubber, acrylonitrile butadiene rubber (NBR), styrene butadiene rubber, butyl rubber, fluororubber, isoprene rubber, silicone rubber, and ethylene oxide. It is especially preferable to mix the chloroprene rubber and a polar rubber, especially NBR to suppress the rise of the hardness of the conductive rubber layer and reduce the dependency thereof on temperature.

To obtain a predetermined resistance value, it is very favorable to mix the chloroprene rubber with the polyether polymer containing the epihalohidrin rubber or the ethylene oxide having a high electric conductivity and ionic-conductivity.

When the NBR is mixed with the chloroprene rubber, 5 to 50 parts by weight of the NBR is used for 100 parts by weight of the rubber component. To prevent a decrease of the charged amount of the toner, it is preferable that the content of the NBR is not more than 50 parts by weight. To obtain the substantial effect of preventing the rise of the hardness of the conductive rubber layer and reduce the dependency thereof on temperature, it is preferable that the content of the NBR is in the range of 5 to 20 parts by weight.

As described above, the semiconductive rubber member of the present invention that is preferably used as the developing roller has a dielectric loss tangent of 0.1 to 1.8 when an alternating current is applied thereto at a voltage of five volts and a frequency of 100 Hertz.

The dielectric loss tangent in the electrical characteristic of the rubber roller is an index indicating the flowability (dielectric constant) of electricity and the influence degree of a capacitor component (electrostatic capacity) and is a parameter showing a phase lag when alternating current is applied to the developing roller. That is, the dielectric loss tangent indicates the degree of the ratio of the capacitor component when the voltage is applied to the developing roller.

That is, the dielectric loss tangent is indicated by a charged amount generated when an amount regulation blade brings toner into contact with the developing roller at a high voltage and a charged amount which escapes to the developing roller before the toner is transported to the photoreceptor. That is, the dielectric loss tangent is an index indicating the charged amount immediately before the toner contacts the photoreceptor.

When the dielectric loss tangent is large, it is easy for electricity (electrical charge) to flow through the developing roller and difficult for polarization to progress. On the other hand, when the dielectric loss tangent is small, it is difficult for electricity (electrical charge) to flow through the developing roller and easy for the polarization to progress. Thus when the dielectric loss tangent is small, the developing roller has a high capacitor-like characteristic and thus it is possible to maintain an electrical charge generated on the toner by a frictional electrical charge without escaping it from the developing roller. That is, when the dielectric loss tangent is small, charging property can be imparted to the toner, and the imparted charging property can be maintained. To obtain this effect, the dielectric loss tangent is set to not more than 1.8. The dielectric loss tangent is set to not less than 0.1 to prevent a printed density from decreasing excessively owing to an excessive rise of the charged amount and prevent the rubber from becoming hard because a large amount of additives is added to the rubber component to adjust the dielectric loss tangent.

The dielectric loss tangent is set to favorably not less than 0.3, and more favorably not less than 0.5. The dielectric loss tangent is set to favorably not more than 1.5, more favorably not more than 1.0, and most favorably not more than 0.8.

The dielectric loss tangent is measured by a method described in the description of the examples which will be made later.

To adjust the dielectric loss tangent of the conductive rubber roller to the above-described predetermined range, it is preferable to mix 5 to 70 parts by weight of carbon black with 100 parts by weight of the rubber component of the conductive rubber layer.

The known carbon black is used. To obtain ionic-conductivity, it is preferable to use carbon black having a low conductivity.

The particle of the carbon black having a low conductivity has a large diameter, has a structure of a low degree of development, and a low degree of contribution to conductivity. The addition of the carbon black having a low conductivity to the conductive rubber component allows a capacitor-like operation to be obtained owing to polarization without increasing conductivity and allows the charging property to be controlled without deteriorating uniformity of the electric resistance.

The above-described effect can be obtained more effectively by using the carbon black having a low conductivity whose primary particle diameter is not less than 80 nm and preferably not less than 100 nm. When the primary particle diameter is not more than 500 nm and favorably not more than 250 nm, the primary particle is allowed to have a very low degree of surface roughness. It is preferable that the carbon black having a low conductivity has a spherical configuration or similar thereto because it has a small surface area.

Various methods can be selectively used to manufacture the carbon black having a low conductivity. Above all, the carbon black having a low conductivity manufactured by a furnace method or a thermal method is favorable. The carbon black having a low conductivity manufactured by the furnace method is more favorable than the carbon black having a low conductivity manufactured by thermal method. In terms of the kind of carbon, SRF, FT, and MT are preferable. Carbon black for use in a pigment may be used.

Regarding the mixing amount of the carbon black, as described above, it is preferable to use not less than 5 parts by weight of the carbon black for 100 parts by weight of the rubber component to substantially display the effect of reducing the dielectric loss tangent. As described above, it is preferable to use not more than 70 parts by weight thereof for 100 parts by weight of the rubber component to eliminate a fear that owing to an increase in the hardness thereof, the rubber roller damages other members which contact the rubber roller and prevent a decrease in the wear resistance thereof.

It is preferable to use not more than 70 parts by weight of the carbon black for 100 parts by weight of the rubber component to reduce a voltage fluctuation of the electric resistance, namely, to obtain an ionic-conductive characteristic.

As an electroconductive agent for use in the rubber roller to be used as the developing roller of the present invention includes, in addition to the above-described carbon black, carbon black whose particle diameter is smaller than that of the above-described carbon black; conductive metal oxides such as zinc oxide, potassium titanate, antimony-doped titanium oxide, tin oxide, and graphite; and carbon fiber.

To provide the rubber roller of the present invention with electroconductive characteristic, it is not preferable to use the above-described carbon black having a low conductivity because it has a very low conductivity. The carbon black having a low conductivity may be used in combination with the above-described electroconductive agent to lower the dielectric loss tangent and improve abrasive property and extruding property.

To make the resistance value of the conductive rubber layer uniform, it is preferable that the conductive rubber layer has an ionic-conductive rubber component. In that case, the carbon black having a low conductivity is used at 10 to 70 parts by weight and favorably at 20 to 65 parts by weight for 100 parts by weight of the rubber component. It is more favorable to use furnace carbon black manufactured by the above-described furnace method at 25 to 60 parts by weight thereof for 100 parts by weight of the rubber component.

Because these carbons have particles comparatively large in the diameter thereof and are spherical, the particles are dispersed uniformly in a nano-order in the rubber. Therefore the rubber is allowed to be uniform and highly dielectric without coating the rubber.

When the conductive rubber layer is not ionic-conductive, it is preferable to use known conductive carbon black such as ketchen black, furnace black or acetylene black in combination with the above-described carbon black having a low conductivity. It is preferable to add 10 to 20 parts by weight of the conductive carbon black for 100 parts by weight of the rubber component.

It is possible to adjust the dielectric loss tangent to the above-described predetermined range by adding calcium carbonate treated with fatty acid to the conductive rubber layer. The calcium carbonate treated with the fatty acid has a higher activity than ordinary calcium carbonate because the fatty acid is present on the interface of the calcium carbonate. Further the calcium carbonate treated with the fatty acid is lubricant, it can be dispersed easily and stably. When the polarization action is accelerated by the calcium carbonate treated with the fatty acid, the capacitor-like operation increases in the rubber owing to the above-described two actions. Thus it is possible to reduce the dielectric loss tangent efficiently. As the calcium carbonate treated with the fatty acid, it is preferable to coat the entire surface of particles of the calcium carbonate with fatty acid such as stearic acid. The mixing amount of the calcium carbonate treated with the fatty acid is 30 to 80 parts by weight and favorably 40 to 70 parts by weight for 100 parts by weight of the rubber component. It is preferable to use not less than 30 parts by weight of the calcium carbonate treated with the fatty acid to substantially display the effect of reducing the dielectric loss tangent. It is preferable to use not more than 80 parts by weight of the calcium carbonate treated with the fatty acid to prevent the rise of the hardness of the conductive rubber layer and the fluctuation of the electric resistance thereof.

As described above, the conductive rubber layer of the present invention may be ionic-conductive or/and electronic-conductive. The rubber component of the conductive rubber layer of the present invention is ionic-conductive, because the ionic-conductive rubber component of the conductive rubber layer provides a uniform electrical characteristic. Supposing that the resistance value at the time when 500V is applied to the semiconductive rubber member is R500 and that the resistance value at the time when 100V is applied thereto is R100, it is more favorable that $\log(R100)-\log(R500)<0.5$. The difference between the resistance value at the time when 100V is applied to the conductive rubber roller and the resistance value at the time when the reference voltage of 500V proximate to a developing bias is applied thereto is set as an index to clarify the uniform electrical characteristic of the conductive rubber roller. It is preferable that the conductive rubber layer of the present invention is ionic-conductive, because the ionic-conductive rubber layer depends on a voltage to a low extent.

When the rubber component of the conductive rubber layer contains the carbon black and thus is electronic-conductive, the value of the above-described equation is not less than 1. The method of measuring the resistance value is as described in the examples.

To make the rubber component of the conductive rubber layer ionic-conductive, the known method of blending an ionic-conductive rubber or adding an ionic-conductive agent is used. As the ionic-conductive rubber, it is possible to use rubber materials having polar groups in their compositions. More specifically, elastomers containing epihalohydrin rubber (especially, epichlorohydrin rubber) and ethylene oxide can be preferably used. For example, it is possible to use epichlorohydrin (EP) homopolymerized rubber, epichlorohydrin-ethylene oxide (EO) copolymer, epichlorohydrin-propylene oxide (PO) copolymer, epichlorohydrin-allyl glycidyl ether (AGE) copolymer, epichlorohydrin-ethylene oxide-allyl glycidyl ether copolymer, epichlorohydrin-propylene oxide-allyl glycidyl ether copolymer, epichlorohydrin-ethylene oxide-propylene oxide-allyl glycidyl ether copolymer.

When the ionic-conductive rubber is blended, the content of the chloroprene rubber is favorably not more than 90 parts by weight, more favorably not more than 75 parts by weight, and most favorably not more than 60 parts by weight for 100 parts by weight of the rubber component. To obtain the effect of imparting charging property to the conductive rubber layer, the content of the chloroprene rubber is not less than 5 parts by weight and favorably not less than 10 parts by weight for 100 parts by weight of the rubber component. When the performance of charging the toner is low, it is favorable to use not less than 20 parts by weight of the chloroprene rubber for 100 parts by weight of the rubber component.

As described above, it is preferable that the monomer constituting the conductive rubber layer contains ethylene oxide and that the conductive rubber layer contains rubber to which the epichlorohydrin is selectively added.

In that case, it is preferable that the total mol % of a chloroprene monomer constituting the chloroprene rubber and the epichlorohydrin is higher than the mol % of the ethylene oxide.

It is also preferable that the mol % of the chloroprene monomer constituting the chloroprene rubber is higher than the mol % of the epichlorohydrin.

It is also preferable that the mol % of the chloroprene monomer constituting the chloroprene rubber is higher than the mol % of the ethylene oxide.

Provided that the outermost layer of the semiconductive rubber member of the present invention to be used as the developing roller is composed of the conductive rubber layer, the semiconductive rubber member is not demanded to have a specific construction, but may have a plurality of layers, for example, two layers in dependence on demanded performance. However, it is preferable that the conductive rubber layer has a one-layer construction because the conductive rubber member having the one-layer construction has little variations in its properties and can be produced at a low cost.

Therefore the semiconductive rubber member to be used as the developing roller of the present invention consists of the conductive rubber layer. It is favorable that an oxide film is formed on the surface of the conductive rubber layer by irradiating the surface thereof with ultraviolet rays and/or ozone.

The oxide film serves as a dielectric layer, and the dielectric loss tangent of the rubber roller can be reduced. Therefore the dielectric loss tangent can be easily controlled within the predetermined range. Further because the oxide film is formed as a frictional layer having a low frictional coefficient, the toner can be separated favorably therefrom. Thereby images can be formed easily and consequently favorable images can be obtained.

It is preferable that the oxide film has a large number of C═O groups or C—O groups. As described above, the oxide film is formed on the surface of the conductive rubber layer by irradiating the surface thereof with ultraviolet rays and/or ozone to oxidize the surface thereof. The ultraviolet rays are more favorable than the ozone because the oxide film formed by using the former takes a shorter period of time and costs lower.

The processing for forming the oxide film can be performed by using known methods. For example, the surface of the conductive rubber layer should be irradiated with the ultraviolet rays having a wavelength of favorably 100 nm to 400 nm and more favorably 100 nm to 200 nm for 30 seconds to 30 minutes and favorably 1 to 10 minutes while the rubber roller is being rotated, although the wavelength varies according to the distance between the surface of the rubber layer and an ultraviolet ray irradiation lamp and according to the kind of rubber. It is necessary that the intensity of the ultraviolet rays and irradiation conditions (time period, temperature of bathe distance) are selected according to the condition in which the dielectric loss tangent can be adjusted to the range specified in the present invention.

In irradiating the oxide film with the ultraviolet rays, rubber such as NBR which is deteriorated with ultraviolet rays is used at not more than 50 parts by weight. It is very effective to use chloroprene and the chloroprene rubber when the surface of the conductive rubber layer is irradiated with the ultraviolet rays.

Supposing that the resistance value at the time when 50V is applied to the conductive rubber roller is R50 before the oxide film is formed and that the resistance value at the time when 50V is applied thereto is R100 after the oxide film is formed, it is favorable that $\log(R50a)-\log(R50)=0.2$ to 1.5 to improve the durability of the conductive rubber roller, decrease a change of the electric resistance when the conductive rubber roller is used, decrease a stress to be applied to the toner, and prevent failure of the photoreceptor. The resistance value at the time when the low voltage of 50V which can be applied stably to the conductive rubber roller is set as the index value. Thereby it is possible to accurately capture a slight rise of the electric resistance caused by the formation of the oxide film. The lower limit of the solution of the above-described equation is favorably 0.3 and more favorably 0.5. The upper limit of the solution of the above-described equation is favorably 1.2 and more favorably 1.0.

It is preferable that the conductive rubber layer of the present invention contains an acid-accepting agent to prevent chlorine-containing gases such as HCl generated when rubber is vulcanized from remaining so that the photoreceptor and other members can be prevented from being contaminated. As the acid-accepting agent, various substances acting as an acid-acceptor can be used. Above all, hydrotalcite is preferable because it is excellent in its dispersibility. It is possible to obtain a high acid-receiving effect by using the hydrotalcite in combination with magnesium oxide or potassium oxide. Thereby it is possible to securely prevent the photoreceptor from being contaminated.

It is preferable to mix the hydrotalcite at favorably not less than 1 nor more than 10 parts by weight for 100 parts by weight of the rubber component. To display the above-described effect effectively, the mixing amount of the hydrotalcite is preferably not less than one part by weight. To prevent the rise of the hardness of the conductive rubber layer and much acid-accepting agent from remaining with the acid-accepting agent unreacted with the chlorine-containing gas, the mixing amount of the hydrotalcite is preferably not more than 10 parts by weight.

The conductive rubber layer may contain various additives so long as they are unfit for the objects of the present invention. As the additives, it is possible to use, a vulcanizing agent, a processing aid, a plasticizer, a deterioration prevention agent such as an age resistor, an ionic-conductive agent, and the like.

As the vulcanizing agent, it is possible to use sulfur-containing vulcanizing agent, a thiourea-containing vulcanizing agent, a triazine-containing vulcanizing agent, peroxides, and monomers. These vulcanizing agents can be used singly or in combination of two or more thereof. As the sulfur-containing vulcanizing agent, it is possible to use organic sulfur-containing compounds such as powdery sulfur, tetramethylthiuram disulfide or N,N-dithiobismorpholine. As the thiourea-containing vulcanizing agent, one or a plurality of thioureas can be selected from among the group of tetramethylthiourea, trimethylthiourea, ethylenethiourea, and thioureas indicated by $(C_nH_{2n+1}NH)_2C{=}S$ (n=integers 1 to 10). As the peroxides, benzoyl peroxide can be used. The vulcanizing agent is added to 100 parts by weight of the rubber component at favorably not less than 0.2 parts by weight nor more than 5 parts by weight and more favorably not less than 1 part by weight nor more than 3 parts by weight.

The thiourea-containing vulcanizing agent is favorably used as the vulcanizing agent of the present invention. It is more favorable to use ethylene thiourea. The rubber component is vulcanized with the thiourea-containing vulcanizing agent, particularly with the ethylene thiourea to adjust the compression set to not more than 10% and favorably not more than 5%. Thereby accuracy can be secured in an abrading processing time. Further it is possible to manufacture products which is prevented from being damaged or broken in transport and withstands storage in environment having a high temperature. Further the oxide film can be formed easily with ultraviolet rays. In this case, the thiourea-containing vulcanizing agent and the triazine-containing vulcanizing agent are used for 100 parts by weight of the rubber component at favorably not less than 0.2 parts by weight nor more than 3 parts by weight and more favorably not less than 1 part by weight nor more than 2 parts by weight.

As the plasticizer, it is possible to use dibutyl phthalate (DBP), dioctyl phthalate (DOP), tricresyl phosphate and wax. As the processing aid, fatty acid such as stearic acid can be used.

The plasticizing component is used for 100 parts by weight of the rubber component of the rubber layer at favorably not more than 5 parts by weight to prevent bleeding from occurring in forming the oxide film and the photoreceptor from being contaminated in mounting the developing roller on a printer and operating it. Therefore polar wax is preferably used.

As the deterioration prevention agent, various age resistors can be used. When NBR rubber is added to the rubber component to adjust the hardness of the rubber and improve processability, it is preferable to mix an antioxidant with the rubber component as the age resistor. When the antioxidant is used, it is preferable to appropriately select the mixing amount thereof to efficiently advance the formation of the oxide film on the surface of the conductive rubber layer.

To prevent oozing of added additives, it is effective to treat the surface of the conductive rubber layer by irradiating the surface thereof with the ultraviolet rays.

To adjust the resistance value, ionic-conductive agent may be added to the rubber component in addition to the use of the electroconductive agent or blending the ionic-conductive rubber.

Various ionic-conductive agents can be selectively used. It is preferable to add 0.1 to 5 parts by weight of the ionic-conductive agent to 100 parts by weight of the rubber component. For example, it is preferable that the anion-containing salt having the fluoro group (F—) and the sulfonyl group (—$SO_2$—) includes at least one salt selected from among a salt of bisfluoroalkylsulfonylimide, a salt of tris (fluoroalkylsulfonyl) methane, and a salt of fluoroalkylsulfonic acid.

In the above-described salts, anions are stable because the electrical charge are not localized owing to a strong electron attraction effect. Thus the salts show a high degree of dissociation in a polyethylene oxide and allow the conductive elastomer composition to have a very high ionic conductance. It is possible to realize a low electric resistance efficiently by using the anion-containing salt having the fluoro group (F—) and the sulfonyl group (—$SO_2$—). Thus by appropriately adjusting the mixing ratio of the polymer component, the conductive elastomer composition is capable of maintaining a low electric resistance and suppressing the stain of the photosensitive member.

Lithium salts are preferable as the anion-containing salt having the fluoro group (F—) and the sulfonyl group (—$SO_2$). Salts of the alkali metals, the group 2A metals, and other metals may be used as the anion-containing salt having the fluoro group (F—) and the sulfonyl group (—$SO_2$—). The conductive elastomer composition may contain salts having cations shown by the following formulas 1 and 2.

In the following formulas 1 and 2, the reference symbols $R_1$ through $R_6$ show alkyl group having 1 to 20 carbon atoms or its derivatives. $R_1$ through $R_4$ may be identical to or different from each other. Similarly, $R_5$ and $R_6$ may be identical to or different from each other. It is particularly preferable to use a salt containing trimethyl-type quaternary ammonium cations consisting of three of $R_1$ through $R_6$ and one alkyl group or its derivative having favorably 4 to 20 carbon atoms and more favorably 8 to 20 carbon atoms. This is because three methyl groups, having strong electron-donating property, of the salt is capable of stabilizing the positive electrical charge of nitrogen atoms. In addition, the alkyl group or its derivative is capable of improving compatibility of the salt with the ionic-conductive elastomer component. In the cations shown by the chemical formula 2, it is preferable that $R_5$ or $R_6$ consists of methyl group or ethyl group because the alkyl group or its derivatives $R_5$ or $R_6$ having a stronger electron-donating property is capable of stabilizing the positive electrical charge of nitrogen atoms. By stabilizing the positive electrical charge of the nitrogen atoms, it is possible to increase the degree of stability of the cations and thereby form salts having a higher dissociation degree and superior conductance-imparting performance.

Chemical formula 1

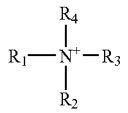

Chemical formula 2

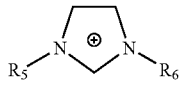

As the anion-containing salt having the fluoro group(F—) and the sulfonyl group (—$SO_2$—), $LiCF_9SO_3$, $LiN(SO_2CF_3)_2$, $LiC(SO_2CF_3)$, $LiCH(SO_2CF_3)_2$, and $LiSF_6CF_2SO_3$ can be used.

It is preferable that the anion-containing salt having the fluoro group (F—) and the sulfonyl group (—$SO_2$—) is dispersed uniformly in the elastomer component. Of the above-described salts, the salt of bisfluoroalkylsultonylimide such as $LiN(SO_2CF_3)_2$ is preferable because it has a high solubility in the chain of the polyethylene oxide and is capable of plasticizing the chain of the polyethylene oxide. Thus by adding the salt having the fluoro group (F—) and the sulfonyl group (—$SO_2$—) to the ionic-conductive elastomer component, it is possible to reduce the hardness of the conductive elastomer composition and reduce the dependence of the volume specific resistance value on environment. In particular, lithium-bis (trifluoromethanesulfonyl) imide ($LiN(SO_2CF_3)_2$) can be readily dispersed in the elastomer component by adding it directly to ionic-conductive rubber such as epihalohidrin rubber. Thereby it is possible to reduce the compression set of the conductive elastomer composition without adversely affecting the hardness thereof. Thus the lithium-bis (trifluoromethanesulfonyl) imide can be preferably used.

In addition, borate, lithium salts, ammonium salts can be added to the rubber component. Particularly, the chloroprene is compatible with salts of the halogen and salts of chlorine. For example, the chloroprene is very stable with salts of ammonium perchlorate, salts of boron, salts of imide lithium. Therefore it is possible to prevent oozing of the additives in a successive use and thus prevent the photoreceptor from being contaminated. In addition, the hardness of the surface of the conductive rubber layer is increased by irradiating the surface thereof with the ultraviolet rays. Further the density is increased by oxidation. Thus it is possible to prevent the oozing of the additives. Thereby the rubber roller of the present invention can be favorably used.

When the semiconductive rubber member of the present invention is used as the developing roller, the resistance value of the developing roller when 500V is applied thereto is $10^5\Omega$ to $10^8\Omega$ and favorably $10^5\Omega$ to $10^7\Omega$.

It is preferable that the resistance value of the developing roller is not less than $10^5\Omega$ to prevent defective images from being formed by controlling electric current flowing therethrough and prevent a discharge to the photoreceptor from occurring. It is preferable that the resistance value of the developing roller is not more than $10^8\Omega$ to keep supplying the toner efficiently to the photoreceptor and prevent defective images from being formed because a voltage drops in the developing roller in transferring toner to the photoreceptor and as a result, the toner cannot be transported to the photoreceptor securely. When the resistance value of the developing roller is not more than $10^7\Omega$, the developing roller can be used widely in various conditions.

When the semiconductive rubber member of the present invention is used as the developing roller, JIS A (K-6253) hardness thereof is favorably not more than 75 degrees and more favorably not more than 70 degrees. That is, it is preferable that JIS A (K-6253) hardness is low. It is preferable that the JIS A (K-6253) hardness is not less than 50 degrees to secure a predetermined wear resistance and abrasive accuracy. When the surface of the conductive rubber layer is irradiated with the ultraviolet rays, the JIS A (K-6253) hardness can be set to a lower degree. For example, even when the conductive rubber roller has the JIS A (K-6253) hardness at not less than 40 degrees, the conductive rubber roller is provided with a preferable characteristic in terms of the wear resistance.

The compression set in a test, in which a sample is allowed to stand, conducted in a high-temperature environment at 50° C. is favorably not more than 10% and more favorably not more than 5%. When the compression set is within the above-described range, a trace is hardly formed in the nip portion disposed between a regulation blade and the developing roller.

The charged amount is not less than 20 μC/g and more favorably not less than 28.5 μC/g in measurement which will be described later.

When the semiconductive rubber member of the present invention is used as the developing roller, a cleaning roller, a charging roller or a transfer roller, a core metal is mounted on the semiconductive rubber member. It is possible to use a core metal made of metal such as aluminum, aluminum alloy, SUS or iron or ceramics. When the semiconductive rubber member of the present invention is used as the developing roller, the thickness of the conductive rubber layer is favorably in the range of 0.5 to 10 mm and more favorably in the range of 1 to 7 mm. To allow the nip to be appropriately wide and obtain the effect of the rubber elasticity, the thickness of the conductive rubber layer is favorably not less than 0.5 mm. To make the developing roller compact and lightweight, the thickness of the conductive rubber layer is favorably not more than 10 mm.

The developing roller of the present invention is used for the image-forming mechanism of electrophotographic apparatuses of office appliances such as a laser beam printer, an inject printer, a copying machine, a facsimile, and an ATM.

The developing roller of the present invention is preferably used to attach unmagnetic one-component toner having a positive charging property to the photoreceptor.

The chloroprene contained in the conductive rubber layer of the developing roller of the present invention has the property of charging toner positively to a high extent owing to its structure. Thus the chloroprene is suitable for the toner which having a positive charging property. The developing method used for the image-forming mechanism of the electrophotographic apparatus in terms of the relationship between the photoreceptor and the developing roller is classified into a contact method and a non-contact method. The conductive rubber roller of the present invention can be utilized by both methods. It is preferable that the developing roller of the present invention is almost in contact with the photoreceptor.

In addition to the developing roller, the conductive rubber member of the present invention can be used as the charging roller for uniformly charging the photoreceptor, a transfer roller for transferring a toner image to a transfer belt and paper from the photoreceptor, a toner supply roller for transporting the toner, and a driving roller, disposed at the inner side of a transfer belt, for driving the transfer belt.

When the conductive rubber member of the present invention is used as the cleaning roller for cleaning the toner on the photoreceptor and the transfer belt, the toner can be electrostatically adsorbed to the cleaning roller and discharged to a collecting apparatus. Thus the cleaning roller can be suitably used for a mechanism for electrostatically collecting the toner to the collecting apparatus. The conductive rubber member of the present invention is preferably used as the cleaning blade and transfer drum.

EFFECT OF THE INVENTION

In the semiconductive rubber member of the present invention that is used as the developing roller, it is possible to impart a very high electrical charge to toner or the like by composing the outermost layer of the developing roller of the rubber material containing the chloroprene rubber and prevent the leak of the electrical charge imparted to the toner by adjusting the dielectric loss tangent of the developing roller to 0.1 to 1.8 when an alternating current is applied to the developing roller at a voltage of five volts and a frequency of 100 Hertz. Thereby it is possible to hold the charged amount of the toner present on the surface of the developing roller on a high level. Thereby a high-quality image can be formed by an electrophotographic apparatus having the semiconductive rubber member of the present invention such as the developing roller. Further the developing roller eliminates the need for a particular equipment for forming a surface-coating layer thereon. That is, it is unnecessary to multi-layer the conductive rubber roller. Therefore it is possible to manufacture the developing roller at a low cost without deteriorating the yield of products.

DETAILED DESCRIPTION OF THE PREFERRED EMBODIMENTS

The embodiments of the present invention will be described below with reference to drawings.

Figure 1:
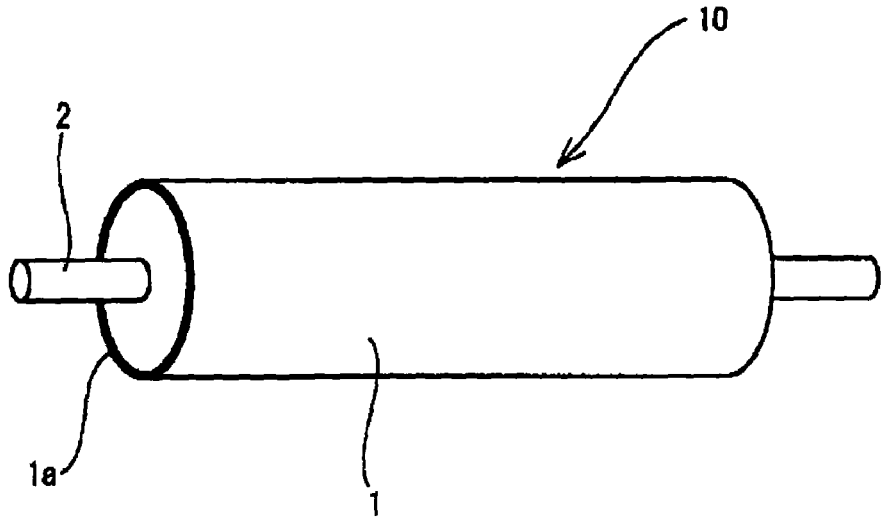
FIG. 1 is a schematic view of a conductive rubber roller of the present invention.

As shown in FIG. 1, a conductive rubber roller 10 has a single cylindrical rubber layer 1 having a thickness of 10 mm and a columnar metal core (shaft) 2 inserted into a hollow portion of the rubber layer 1 by press fit.

The rubber layer 1 and the metal core 2 are bonded to each other with a conductive adhesive agent. The surface of the rubber layer 1 is oxidized with ultraviolet rays to form an oxide film thereon.

The rubber layer 1 contains 10 to 90 parts by weight of chloroprene rubber for 100 parts by weight of the whole rubber component. Epichlorohydrin rubber is mixed with the chloroprene rubber.

To adjust the dielectric loss tangent to a predetermined range, 20 to 70 parts by weight of carbon black is added to 100 parts by weight of the rubber component.

Thiourea-based vulcanizing agent (ethylene thiourea) is mixed with the rubber component. 1 to 10 parts by weight of hydrotalcite serving as an acid-accepting agent is added to 100 parts by weight of the rubber component to prevent the photoreceptor from being contaminated.

The conductive rubber roller 10 of the present invention to be used as the developing roller is manufactured by the following method: After the rubber composition containing the above-described components is kneaded, it is preformed by extruding it cylindrically from an extruder. The extruded rubber composition is cut to a predetermined size to obtain a preform. Thereafter the preform is supplied to a vulcanizing can to vulcanize it at a temperature at which the rubber component is crosslinked. Thereafter a core metal is inserted into the cylindrical rubber layer.

An oxide film 1*a* is formed on the surface of the conductive rubber layer. The oxide film does not necessarily have to be formed.

The surface of the rubber roller is polished by a cylindrical polishing machine to a mirror-like surface finish to set the surface roughness Rz thereof to not more than 6.5 μm and favorably 3 to 5 μm. After the surface of the rubber roller is washed with water, the surface of the rubber roller is irradiated with ultraviolet rays (184.9 nm) emitted by an ultraviolet ray irradiator to form the oxidized film 1*a*.

More specifically, the rubber roller is irradiated with the ultraviolet rays at intervals of 90 degrees in the circumferential direction thereof for favorably 1 to 15 minutes and more favorably 5 to 10 minutes. The rubber roller is rotated by 90 degrees four times in its circumferential direction to form the oxide film on the entire peripheral surface thereof.

The dielectric loss tangent of the developing roller including the conductive rubber roller of the present invention obtained in the above-described method is adjusted to not less than 0.1 nor more than 1.8 when an alternating current is applied to the developing roller at a voltage of five and a frequency of 100 Hertz.

The resistance value of the developing roller is set to $10^5\Omega$ to $10^8\Omega$, when a voltage of 500V is applied thereto. The JIS A (K-6253) hardness thereof is set to not more than 65 degrees. The compression set in a test, in which a sample is allowed to stand, conducted in a high-temperature environment at 50° C. is set to not more than 10%. The charged amount measured in the method described in the examples is set to not less than 20 μC/g.

Examples 1 Through 8 and Comparison Examples 1 Through 3

Components (numerical values shown in table 1 show part by weight) shown in table 1 and described below were kneaded by a Banbury mixer. Thereafter the kneaded components were extruded from an extruder to obtain a tube having an outer diameter of ϕ22 mm and an inner diameter of ϕ09.5 mm. The tube was mounted on a shaft for vulcanizing use. After the rubber component was vulcanized by a vulcanizing can at 160° C. for one hour, the tube was mounted on a shaft, having a diameter of ϕ10 mm, to which a conductive adhesive agent was applied. The tube and the shaft were bonded to each other in an oven at a temperature of 160° C. After the end of each of the obtained tube was shaped, the surface thereof was polished by traverse polishing and finish polishing to a mirror-like surface finish by using a cylindrical polishing machine so that the diameter of the tube was ϕ20 mm (tolerance: 0.05) to obtain the conductive rubber roller. The surface roughness Rz of the obtained conductive rubber roller was 3 to 5 μm. The surface roughness Rz was measured in accordance with JIS B 0601 (1994).

After the surface of each conductive rubber roller was washed with water, the surface of each of the conductive rubber rollers of the examples 2, 3, 5, 6, and 7 and the comparison examples 1 and 3 was irradiated with ultraviolet rays to form an oxidized layer on the surface thereof by using an ultraviolet ray irradiator ("PL21-200" produced by Sen Tokushu Kogen Inc). The rubber roller was irradiated with ultraviolet rays (wavelength: 184.9 nm and 253.7 nm) at intervals of 90 degrees in its circumferential direction for a predetermined period of time by spacing the ultraviolet ray irradiator by 10 cm from the rubber roller. The rubber roller was rotated by 90 degrees four times to form an oxide film on its entire peripheral surface (360 degrees). The irradiation period of times shown in table 1 and table 2 is the period of time spent to irradiate ¼ (90 degrees) of the entire peripheral surface of the rubber roller.

TABLE 1

| | E1 | E2 | E3 | E4 | E5 | E6 | E7 | E8 |
|---|---|---|---|---|---|---|---|---|
| Chloroprene rubber | 75 | 20 | 50 | 50 | 30 | 80 | 50 | 70 |
| GECO (EO/EP/AGE = 56:40:4) | | 80 | 50 | | 50 | | | |
| ECO (EO/EP = 61:39) | | | | 50 | | | 40 | 25 |
| NBR | 25 | | | | 20 | | | |
| Polyether polymer | | | | | | 20 | 10 | 5 |
| Powder sulfur | 0.5 | 0.5 | 0.5 | 0.5 | 0.5 | 1.4 | 0.5 | 1.4 |
| Ethylene thiourea | 1.4 | 1.4 | 1.4 | 1.4 | 1.4 | 0.3 | 1.4 | 0.3 |
| Hydrotalcite | 3 | 3 | 3 | 3 | 3 | 5 | 5 | 5 |
| Conductive carbon black | 15 | | | | | | | |
| Carbon black having low conductivity | | 50 | 50 | 50 | 40 | 40 | 40 | 50 |
| Calcium carbonate | | | | | | | | |
| Imide lithium salt | | | | | | 2 | | |
| Method of forming oxide film | Not formed | Ultraviolet rays 5 minutes | Ultraviolet rays 5 minutes | Not formed | Ultraviolet rays 10 minutes | Ultraviolet rays 10 minutes | Ultraviolet rays 10 minutes | Not formed |
| Dielectric loss tangent | 0.35 | 0.5 | 0.65 | 1.48 | 0.73 | 0.65 | 0.55 | 1.7 |
| Resistance (500 V; logarithm value) | 5.6 | 5.8 | 6.2 | 6.2 | 6.2 | 5.4 | 6.0 | 6.1 |
| Resistance (100 V; logarithm value) | 7.5 | 6.0 | 6.4 | 6.4 | 6.5 | 5.6 | 6.3 | 6.3 |
| Conductivity | Electronic-conductive | Ionic-conductive | Ionic-conductive | Ionic-conductive | Ionic-conductive | Ionic-conductive | Ionic-conductive | |
| Charged amount (μC/g) | 40.5 | 31.9 | 39.7 | 28.9 | 33.5 | 36.5 | 35.0 | 34.5 |
| Evaluation of image | | | | | | | | |
| Density variation of half-tone image | To some extent | Nil | Nil | To some extent | Nil | Nil | Nil | Nil |
| Density reduction caused by rotation of roller | To some extent | Nil | Nil | Nil | Nil | Nil | Nil | Nil |
| General evaluation | ○ | ○~◎ | ◎ | ○ | ◎ | ◎ | ◎ | ○~◎ |

where E denotes example.

TABLE 2

| | CE1 | CE2 | CE3 |
|---|---|---|---|
| Chloroprene rubber | | | |
| GECO | | | |
| ECO | 100 | 100 | 100 |
| NBR | | | |
| Powder sulfur | 0.5 | 0.5 | 0.5 |
| Ethylene thiourea | 1.4 | 1.4 | 1.4 |
| Hydrotalcite | 3 | 3 | 3 |
| Conductive carbon black | | | 20 |
| Carbon black having low conductivity | 40 | | |
| Calcium carbonate | | 75 | |
| Method of forming oxide film | Ultraviolet rays 5 minutes | Not formed | Ultraviolet rays 5 minutes |
| Dielectric loss tangent | 0.95 | 1.70 | 0.48 |
| Resistance (500 V; logarithm value) | 5.8 | 6.1 | not more than 5.0 |
| Resistance (100 V; logarithm value) | 6 | 6 | 5.5 |
| Conductivity | Ionic-conductive | Ionic-conductive | Electronic-conductive |
| Charged amount (μC/g) | 27.5 | 15.0 | 27.5 |
| Evaluation of image | | | |
| Density variation of half-tone image | Nil | Nil | Conspicuous |
| Density reduction caused by rotation of roller | Nil | Occurred | Nil |
| General evaluation | ○ ~ Δ | X | Δ |

where CE denotes comparison example.

The following components were used to form the conductive rubber roller of each of the examples and the comparison examples:

(a) Rubber Component

Chloroprene rubber: "Shoprene" produced by Showa Denko Inc.

Epichlorohydrin rubber (GECO): "Epichlomer CG102" produced by Daiso Inc. The epichlorohydrin rubber is an epichlorohydrin-containing copolymerizate of 56 mol % of ethylene oxide (EO), 40 mol % of epichlorohydrin (EP), and 4 mol % of allyl glycidyl ether (AGE).

Epichlorohydrin rubber (ECO): "Epichlomer D" produced by Daiso Inc.

Ethylene oxide (EO)/Epichlorohydrin (EP)=61 mol %/39 mol %

Acrylonitrile butadiene rubber (NBR): "Nippol 401LL" produced by Nippon Zeon Inc.

Polyether polymer: "Zeospan ZSN8030 produced by Nippon Zeon Inc.)

ethylene oxide (EO)/propylene oxide (PO)/allyl glycidyl ether (AGE)=9 mol %/4 mol %/6 mol %

Powder sulfur (vulcanizing agent)

Ethylene thiourea (vulcanizing agent): "Accel 22-S" produced by Kawaguchi Kagaku Inc.

Hydrotalcite (acid-accepting agent): "DHT-4A-2" produced by Kyowa Kagaku Kogyo Inc.

Conductive carbon black: "Sheast 3" produced by Tokai Carbon Inc. (example 1)

Conductive carbon black: "Denka black" produced by Denki Kagaku Kogyo Inc. (comparison example 3)

Carbon black having a low conductivity: "Asahi #15" produced by Denki Kagaku Kogyo Inc. (comparison example 3)

Calcium carbonate: "Super S" produced by Maruo Calcium Inc.

The following characteristics of each of the examples and the comparison examples were measured. The results are shown in Tables 1 and 2.

Measurement of Electric Resistance of Rubber Roller

Figure 2:
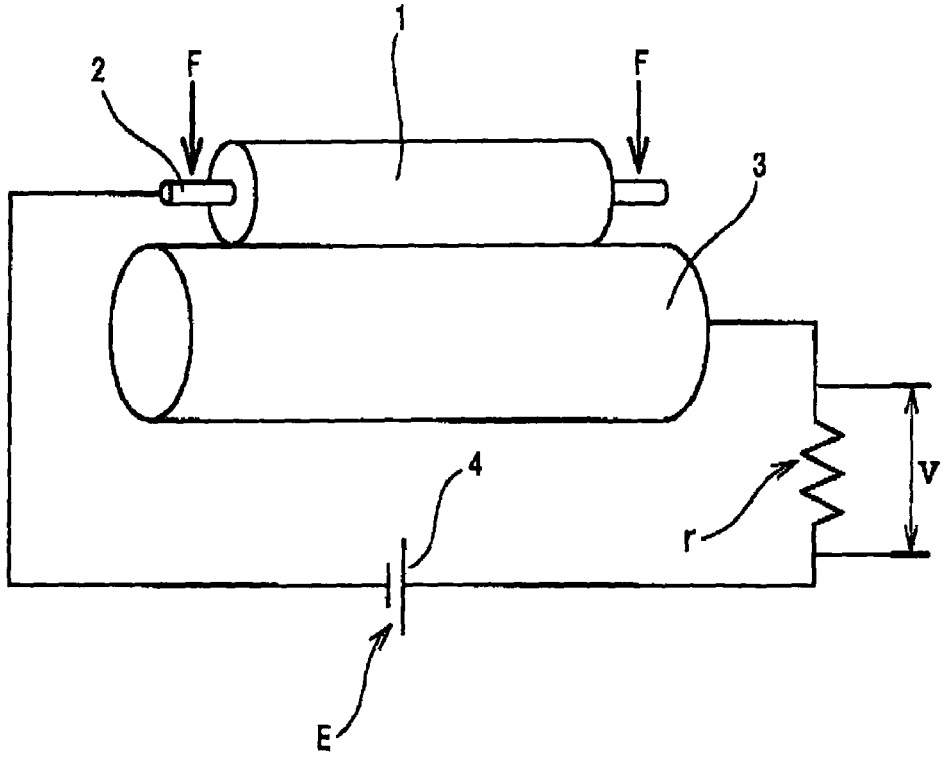
FIG. 2 shows a method of the present invention for measuring the electric resistance of the conductive rubber member.

To measure the electric resistance of the conductive rubber member 10, as shown in FIG. 2, the rubber layer 1 through which the core metal 2 was inserted was mounted on an aluminum drum 1, with the rubber layer 1 in contact with the aluminum drum 3. One end of a conductor having an internal electric resistance of r (100Ω) was connected to the positive side of a power source 4. The other end of the conductor was connected to one end surface of the aluminum drum 3. One end of another conductor was connected to the negative side of the power source 4. The other end of the conductor was connected was connected to one end surface of the conductive rubber roller 10.

A voltage V applied to the internal electric resistance r of the conductor was detected. Supposing that a voltage applied to the apparatus is E, the electric resistance R of the rubber roller 10 is: R=r×E/(V−r). Because the term of −r is regarded as being extremely small, R=r×E/V. A load F of 500 g was applied to both ends of the core metal 2. A voltage E of 500V or 100V was applied to the conductive rubber member 10, while it was being rotated at 30 rpm. The detected voltage V was measured at 100 times during four seconds. The electric resistance R was computed by using the above equation. The measurement was conducted at a constant temperature of 23° C. and a constant humidity of 55%.

Measurement of Dielectric Loss Tangent of Rubber Roller

Figure 3:
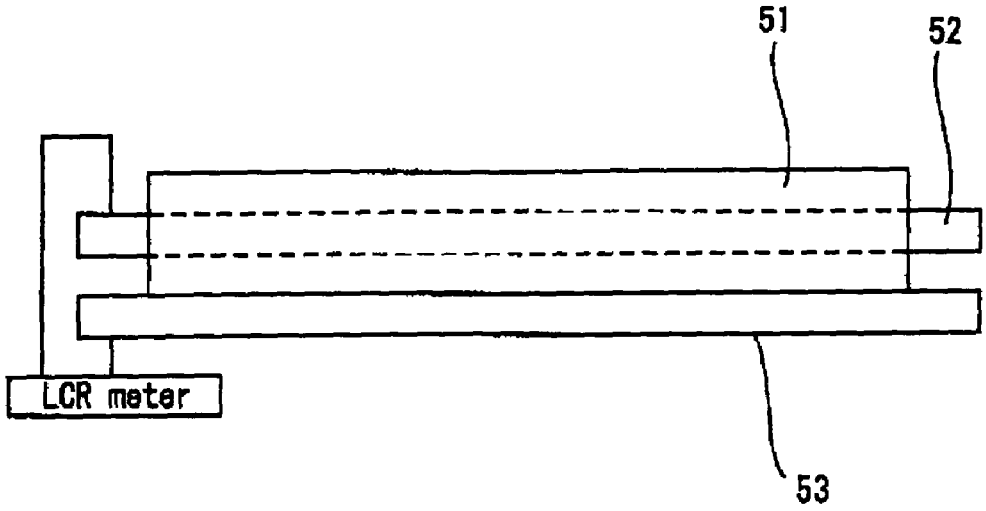
FIG. 3 shows a method of the present invention for measuring the dielectric loss tangent of the conductive rubber member.

As shown in FIG. 3, an alternating voltage of 100 Hertz was applied to a rubber roller 51 at a voltage of five volts and a frequency of 100 Hertz, with a shaft 52 and a metal plate 53, on which a rubber roll 51 was placed, serving as an electrode respectively. An R (electric resistance) component and a C (capacitor) component were measured separately by an LCR meter (AG-4311B, manufactured by Ando Denki) at a temperature of 23° C. to 24° C. (room temperature). The dielectric loss tangent was computed from the value of R and C by using the following equation.

$$\text{Dielectric loss tangent } (\tan\delta) = G/\omega C$$

$$G = 1/R$$

The dielectric loss tangent is found as G/ωC, when the electrical characteristic of one rubber roller is modeled as a parallel equivalent circuit of the electric resistance component of the rubber roller and the capacitor component thereof.

Evaluation of Charging Property of Toner

To examine toner separation, whether the toner was charged uniformly, and stability with time (durability), the rubber roller of each of the examples and the comparison examples was mounted as a developing roller on a laser printer (printer using unmagnetic one-component toner)) commercially available. Images were checked to evaluate the performance of each developing roller. More specifically, after 5% printing was performed on 100 sheets of paper, a 25% halftone image was printed thereon. Density variation of the half-tone image was observed. Reduction of density caused by the rotation of the developing roller was also observed.

More specifically, after the 25% halftone image was printed, the charged amount of the toner was measured to obtain the evaluation parameter. After the 25% halftone image was printed, a cartridge was removed from the laser printer. An attraction type charged amount measuring apparatus ("Q/m METER Model 210 HS-2" manufactured by Treck Inc.) was used to attract the toner from a position above the developing roller to measure the charged amount (μC) of the toner and the weight (g) thereof. The amount of static electricity per weight was computed as the toner charging amount (μC/g). That is, Toner charging amount (μC/g)=charged amount (μC)/weight (g) of toner As shown in table 1, values of the dielectric loss tangent of the rubber rollers of the examples 1 through 8 were very small, namely, in the range of 0.1 to 1.8. Thus it was confirmed that the image was correctly evaluated, that the values of the charged amount were large, and that the developing rollers showed preferable charging property. Thus it was confirmed that these developing rollers were excellent in its practical use.

On the other hand, the rubber rollers of the comparison examples 1 through 3 did not contain the chloroprene rubber but contained only epichlorohydrin rubber (ECO) in the rubber components thereof. Thus they had a low toner-charging property. The rubber roller of the comparison example 2 contained ordinary calcium carbonate as a filler. Therefore it had a small toner-charging amount. As a result, the density during one rotation of the developing roller was very high and dropped to a high extent as the rubber roller rotated. The dielectric loss tangent of the rubber roller of the comparison example 2 was 1.7 that was within the range of the present invention. But the rubber roller did not contain the chloroprene rubber. Thus the rubber roller had a low toner-charging property.

The rubber roller of the comparison example 3 which contained only carbon black as the conductive agent and was thus electronic-conductive had a small dielectric loss tangent, namely, 0.48. As a result, although the rubber roller had a large toner-charging amount, density variation occurred on the sheet on which the image was printed. Thus the evaluation of the image was not good.

It could be confirmed from the results that by increasing the content of the chloroprene, the toner-charging amount can be improved. It could be also confirmed that the resistance value of the rubber could be made uniform by blending the chloroprene and the epichlorohydrin rubber with each other and that the density variation could be reduced. When the rubber roller was ionic-conductive, the density variation could be almost eliminated. Thereby an excellent developing roller could be manufactured.

Tensile Strength

The tensile strengths of the conductive rubber materials of the examples 2 through 7 and the comparison example 1 were measured in accordance with JIS K 6251. As a result, the tensile strength of the conductive rubber material of the comparison example 1 was 9 MPa. The tensile strengths of the conductive rubber materials of the examples 2 through 4, 6, and 7 were 12 to 17 MPa which were much larger than that of the comparison example 1. It could be confirmed that the use of the chloroprene was very effective for allowing the rubber roller to be durable.

The examples 7 and 8 indicate that the rubber which is the blend of three components, namely, the chloroprene rubber, the epichlorohydrin rubber, and the polyether polymer was dispersed more favorably and uniformly in the form of islands than the rubber which is the blend of two components, namely, the chloroprene rubber and the epichlorohydrin rubber.

The mixing degree of the filler, particularly the dielectric loss tangent-adjusting agent is different according to the kind of blended rubbers. That is, by making the dispersibility of the rubber favorable, the dielectric loss tangent-adjusting agent can be dispersed uniformly in the blend of rubbers. Thus it is possible to provide the rubber roller with a high dielectric property. It was also confirmed that because the dispersibility of the rubber was good, the wear resistance of the rubber roller was excellent.

In the example 5, the chloroprene rubber, the epichlorohydrin rubber (GECO), and the NBR were used. Because the NBR having the same polarity as that the chloroprene rubber and the epichlorohydrin rubber was used, the three substances could be blended favorably with each other. Thus a uniform dispersion state of the rubber was obtained. Therefore the wear resistance degree of the rubber roller of the example 5 was equal to that of the rubber rollers of the examples 7 and 3 or higher than that. It was also confirmed that because the viscosity of the rubber could be reduced, the processability was superior.

In the examples 2, 3, 7, and 8, the total of the mol % of chloroprene monomer composing the chloroprene rubber and that of the epichlorohydrin was set higher than that of the ethylene oxide.

In the examples 3, 7, and 8, the mol % of the chloroprene monomer composing the chloroprene rubber was set higher than that of the epichlorohydrin.

In the examples 3 and 8, the mol % of the chloroprene monomer composing the chloroprene rubber was set higher than that of the ethylene oxide.

It was confirmed that in the examples 2, 3, 7, and 8 having the above-described structure, the toner-charging amount could be increased.

More specifically, although the rubber roller of the example 2 contained a smaller amount of the chloroprene rubber, it has a sufficient toner-charging performance.

The rubber roller of the example 3 having the rubber layer irradiated with ultraviolet rays had a very high charging property.

The rubber roller of the example 7 obtained a higher charging property than the rubber roller of the example 2.

The rubber roller of the example 8 had a high charging property similar to that of the example 7, although the rubber layer thereof was not irradiated with ultraviolet rays.

Although not exemplified, when liquid NBR (for example, Nippol DN223 produced by Nippon Zeon) or the polyether polymer was used, the following advantages were obtained: In the example 6 in which a salt was used, the elongation percentage increased to a high extent. It was confirmed that the durability of a sealing portion of the roller was very high owing to the use of the liquid NBR which allowed the hardness thereof to be low and owing to the use of the polyether polymer which allowed the density to be low. The experiment indicates that the durability and the charging property can be balanced most favorably by using 3 to 25 parts by weight, more favorably 5 to 20 parts by weight, and most favorably 5 to 15 parts by weight of the above-described substances.

What is claimed is:

1. A semiconductive rubber member comprising a conductive rubber layer, containing chloroprene rubber, which composes an outermost layer thereof, wherein when an alternating current is applied to said semiconductive rubber member at a voltage of five and a frequency of 100 Hertz, a dielectric loss tangent thereof is 0.1 to 1.8, wherein said conductive rubber layer contains 5 to 70 parts by weight of conductive carbon black for 100 parts by weight of a rubber component, wherein said rubber component is electrically conductive, and wherein said conductive rubber layer does not contain an ionic-conductive salt.

2. The semiconductive rubber member according to claim 1, wherein said conductive rubber layer contains 1 to 10 parts by weight of hydrotalcite for 100 parts by weight of a rubber component.

3. The semiconductive rubber member, according to claim 1, which is used as a developing roller, a cleaning roller, a charging roller, a transfer roller, a cleaning blade, or a transfer drum.

4. The semiconductive rubber member according to claim 1, wherein said developing roller has a function of attaching an unmagnetic one-component toner having a positive charging property to a photoreceptor.

5. A semiconductive rubber member comprising a conductive rubber layer, containing chloroprene rubber, which composes an outermost layer thereof, wherein when an alternating current is applied to said semiconductive rubber member at a voltage of five and a frequency of 100 Hertz, a dielectric loss tangent thereof is 0.1 to 1.8, wherein said conductive rubber layer contains 5 to 70 parts by weight of conductive carbon black for 100 parts by weight of a rubber component, wherein said rubber component is electrically conductive, and wherein said conductive rubber layer consists of one layer, an outermost surface of said conductive rubber layer is not irradiated with ultraviolet rays and/or ozone to form an oxide film on the outermost surface, and said dielectric loss tangent is 0.1 to 1.0.

6. A semiconductive rubber member comprising a conductive rubber layer, containing chloroprene rubber, which composes an outermost layer thereof, wherein when an alternating current is applied to said semiconductive rubber member at a voltage of five and a frequency of 100 Hertz, a dielectric loss tangent thereof is 0.1 to 1.8, wherein said conductive rubber layer contains 5 to 70 parts by weight of conductive carbon black for 100 parts by weight of a rubber component, wherein said rubber component is electrically conductive, and wherein said rubber component contains 5 to 50 parts by weight of acrylonitrile butadiene rubber based on 100 parts by weight of the rubber component.

* * * * *